US006814187B2

(12) United States Patent
Brown et al.

(10) Patent No.: US 6,814,187 B2
(45) Date of Patent: Nov. 9, 2004

(54) SYSTEM FOR DETECTING LIQUID IN AN INGROUND LIFT

(75) Inventors: Doug Brown, Madison, IN (US); Mark Bordwell, Madison, IN (US); Bryan Taylor, Madison, IN (US); David Porter, Madison, IN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 41 days.

(21) Appl. No.: 10/056,985

(22) Filed: Jan. 25, 2002

(65) Prior Publication Data

US 2003/0141151 A1 Jul. 31, 2003

(51) Int. Cl.[7] ..... B66F 7/00

(52) U.S. Cl. ..... 187/205; 187/275; 417/38

(58) Field of Search ..... 187/203, 205, 187/209, 215, 272–275, 414; 405/210, 211, 211.1, 54; 417/36, 38

(56) References Cited

U.S. PATENT DOCUMENTS

| | | | | |
|---|---|---|---|---|
| 942,755 A | | 12/1909 | Schollmeyer | |
| 1,055,099 A | | 3/1913 | Sullivan | |
| 2,640,977 A | | 6/1953 | Parisi | |
| 2,956,581 A | | 10/1960 | Pearson | |
| 3,334,706 A | * | 8/1967 | Dayson | 187/205 |
| 3,775,026 A | | 11/1973 | Hewlings | 417/36 |
| 3,981,619 A | | 9/1976 | Mitter | 417/38 |
| 5,501,299 A | * | 3/1996 | Holmes | 187/272 |
| 5,709,286 A | * | 1/1998 | Mead et al. | 187/205 |
| 5,740,886 A | * | 4/1998 | Fletcher | 187/205 |
| 5,969,619 A | | 10/1999 | Niemiro et al. | |
| 6,244,390 B1 | * | 6/2001 | Yeo et al. | 187/205 |
| 6,571,919 B1 | * | 6/2003 | Stewart | 187/215 |

OTHER PUBLICATIONS

Illustrated Sourcebook of Mechanical Components, Robert O. Parmley, P.E., Editor–in–Chief, Published by McGraw–Hill (pp. 27–14 through 27–17).

* cited by examiner

*Primary Examiner*—Eileen D. Lillis
*Assistant Examiner*—Thuy V. Tran
(74) *Attorney, Agent, or Firm*—Frost Brown Todd LLC

(57) ABSTRACT

A system for detecting liquid in an inground lift has a tube with an open end disposed within the internal cavity defined by the containment housing of the inground lift. The tube is in fluid communication with a source of pressurized gas. A pressure sensor generates a signal if the pressure within the air line exceeds a predetermined level, which occurs if the end is blocked by liquid. A control system is configured to respond to the signal.

9 Claims, 2 Drawing Sheets

SYSTEM FOR DETECTING LIQUID IN AN INGROUND LIFT

BACKGROUND OF THE INVENTION

This application hereby incorporates by reference U.S. patent application Ser. No. 09/884,673, filed Jun. 19, 2001, titled Removable Cylinder Arrangement For Lift, and U.S. patent application Ser. No. 10/055,800, filed Oct. 26, 2001, titled Electronically Controlled Vehicle Lift And Vehicle Service System, both of which are commonly owned herewith.

Inground lifts are well known in the art. Presently, such lifts are typically enclosed in a containment housing designed to protect the lift components from the environment and to protect the environment from the lift components. Liquid can enter the internal cavity defined by the containment housing as a result of many causes, including due to natural condensation, leaks in the lift components, surface water entering through the top, and ground water entering through a leak in the containment housing.

Damage can occur to the lift components if too much liquid accumulates in the internal cavity. It is thus necessary to monitor the internal cavity for the presence of liquid.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF AN EMBODIMENT OF THE INVENTION

Figure 1:
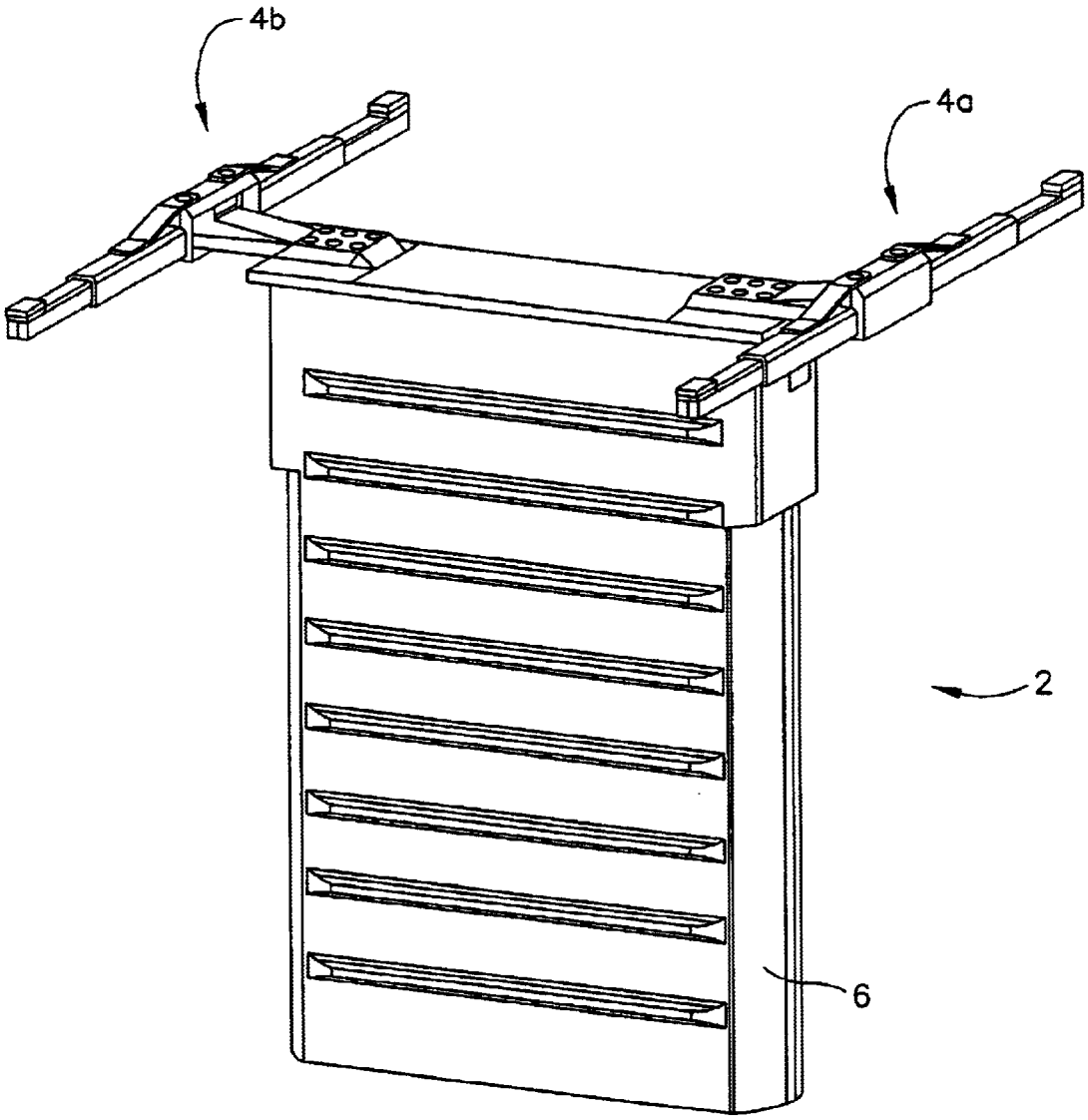
FIG. 1 is a perspective view of an example of a twin plunger inground lift.

Referring now to the drawings in detail, wherein like numerals indicate the same elements throughout the views, FIG. 1 is a perspective view of an example of a twin plunger inground lift, generally indicated at 2. As illustrated, lift 2 includes two vertically moveable lift engagement structures generally indicated at 4*a* and 4*b*, and containment housing 6. When installed, containment housing 6 is disposed substantially entirely below grade, except to the extent that a portion of the top remains exposed, with lift engagement structures 4*a* and 4*b* being positioned on or slightly above the floor in the down position. Vertically moveable lift engagement structures 4*a* and 4*b* are carried by respective vertically moveable cylinders or posts (not shown in FIG. 1) which retract at least partially into the internal cavity defined by containment housing 6.

Although lift 2 is illustrated as a two post lift, inground lifts may have only one post, or may have two posts with each post having a separate containment housing, such as to accommodate the spacing required for large vehicles.

Figure 2:
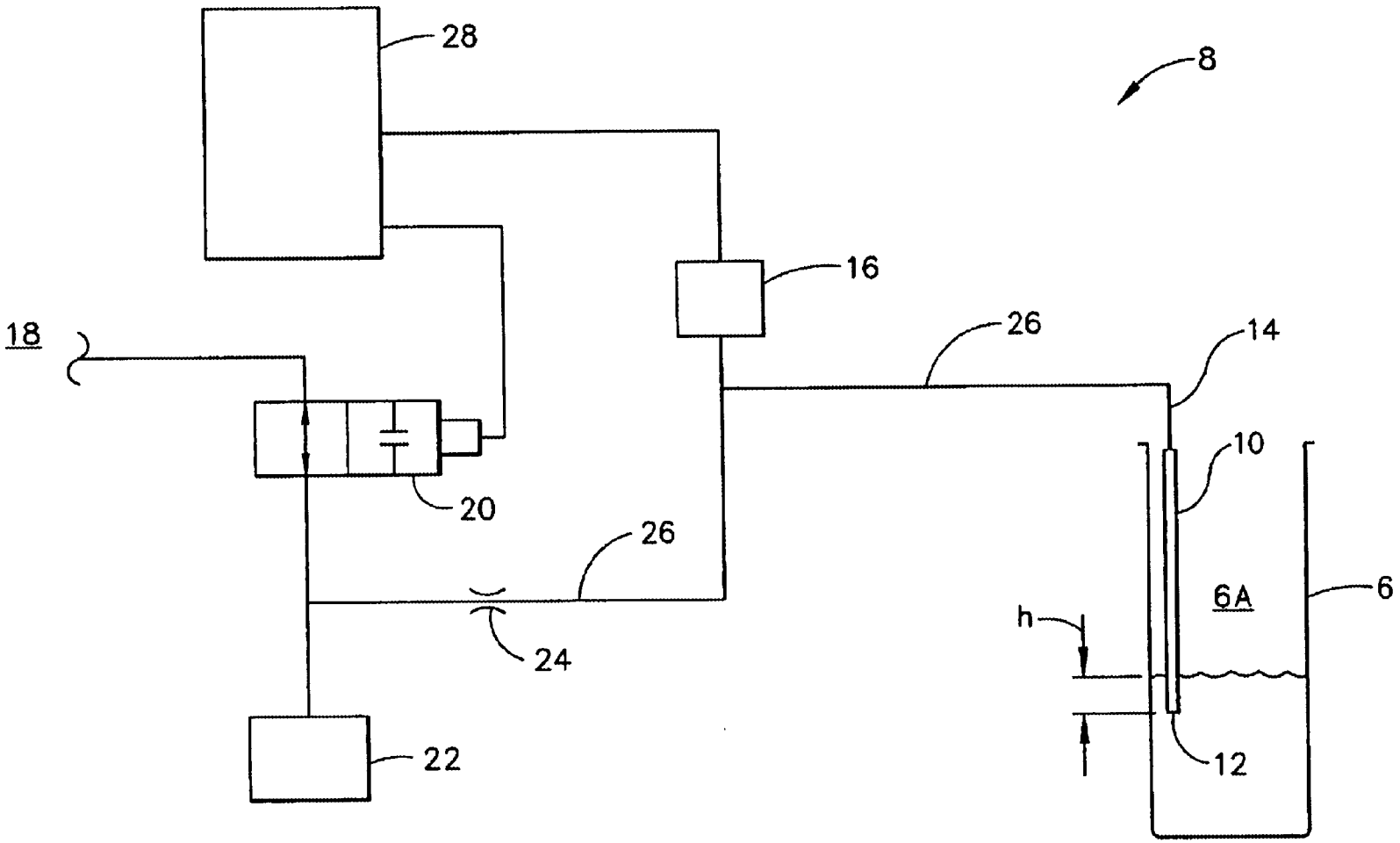
FIG. 2 is a diagrammatic illustration of a system for detecting liquid in an inground lift in accordance with the present invention.

FIG. 2 is a diagrammatic illustration of a system for detecting liquid in an inground lift, generally indicated at 8. As diagrammatically illustrated, internal cavity 6*a* is defined by containment housing 6. System 8 includes hollow tube 10 having open end 12 disposed within internal cavity 6*a*, and open end 14.

Open end 12 is pneumatically connected to pressure sensor 16 and to a source of pressurized air. Although "air" is used herein, it will be understood that any suitable gas may be used for operation of the system. In the embodiment illustrated, tube 10 is selectively placed in fluid communication with source of pressurized air 18 through actuation of valve 20. When valve 20 is actuated, pressurized air is delivered to air cylinder 22 to disengage the lift latches (not shown) pneumatically so that lift engagement structures 4*a* and 4*b* may be lowered.

Flow control valve 24 is interposed between valve 20 and air cylinder 22, and tube 10 and pressure sensor 16. Flow control valve 24 decreases the pressure and allows only a very small amount of air to flow therethrough, and ultimately to tube 10 and out end 12.

Thus, in the depicted embodiment, tube 10 and pressure sensor are in fluid communication with source of pressurized air 18 only when lift engagement structures 4*a* and 4*b* are being lowered. This intermittent delivery of air to tube 10 and out end 12 means that containment housing 6 is not continuously monitored for liquid, but system 8 still provides adequate monitoring while reducing the amount of air used to monitor containment housing 6 for liquid. While the air loss for a single lift, if continuously monitored, is not particularly significant, doing so for multiple lifts can result in significant losses.

It is noted that tube 10 and pressure sensor 16 may alternatively be continuously connected to an air supply for continuous monitoring, or selectively connected to an air supply separate from the air supply for lowering valve 20 for intermittent monitoring.

When tube 10 is in fluid communication with a source of air, air flows freely out unobstructed end 12, which acts as an orifice, when the liquid level in internal cavity 6*a* is lower than end 12. When liquid in internal cavity 6*a* reaches and rises above the end of the tube, as shown in FIG. 2, air flows out against the pressure of the liquid, causing an increase in pressure within the air line 26 connecting tube 10 with pressure sensor 16 and the downstream side of flow control valve 24. The increase in the pressure is a function of the height, h, of the liquid above end 12.

In the depicted embodiment, pressure sensor 16 is a pressure switch which generates a signal once the pressure reaches a predetermined level, preferably relative to the ambient pressure (i.e., gauge pressure). The signal is delivered to control 28.

Alternatively, pressure sensor 16 could be configured to generate a signal proportional to the pressure within air line 26, with control 28 being operably configured to respond only when such proportional signal indicates that the pressure exceeds a predetermined level. A proportional signal could be used to monitor the level of liquid in containment housing 6, once liquid reached end 12, and control 28 could be configured to take different action based on more than one level detection. For example, control 28 could generate a first warning when the pressure signal indicates a first predetermined pressure, and a second warning when the pressure signal indicates a second predetermined signal, etc. Control 28 could then initiate different actions based on the level sensed.

In the depicted embodiment, end 12 is disposed about four inches above the bottom of internal cavity 6*a*. End 12 may be located at different heights, and may even be adjustable. The location of end 12 depends on the specific configuration of the particular lift design. In the depicted embodiment, the four inches above the bottom location was selected because there are no structural members within internal cavity 6*a* below that level. Additionally, based on the cross-sectional area of the depicted embodiment, four inches of liquid in the bottom of containment housing 6 represents about twenty gallons of liquid. A smaller capacity (before liquid is sensed) would result in more frequent service calls to have the internal cavity pumped, which is less economical. It is noted that a pipe coupling may be provided in the top cover of containment housing 6 through which a rigid pipe can be inserted to pump liquid out of internal cavity 6*a*.

In the depicted embodiment, pressure sensor 16 is a normally open diaphragm switch which triggers at three fourths of an inch of water head. While different predetermined levels may be used (as well as variable or adjustable predetermined levels), three quarters of an inch of water head has been found to avoid problems that could occur with a lower level, such as being tripped by barometric pressure, or with a higher level, which would require more air flow through end 12.

In the depicted embodiment, the inner diameter of tube 10 and end 12 is about one quarter inch; flow control valve 24 is a fixed plate orifice with a 0.0075 inch diameter opening, with the upstream pressure being normal shop air at about 125 PSIG. In the depicted embodiment, this produced very little air flow, but sufficient to trip pressure sensor 16 when the height, h, of liquid (water) within internal cavity 6*a* reached three fourths of an inch. It is noted that for liquids having a higher specific gravity than water, the height h at which the pressure will reach the predetermined level will be less than the height h for water.

Within the teaching of the present invention, control 28 can range from being dedicated only to monitoring system 8 to controlling all functions of the lift. Control 28 may respond to the signal from pressure sensor 16 in many different ways. By way of non-limiting examples, it may produce a notification for the operator, it may activate an alarm, it may record the occurrence, it may affect operation of the lift.

In one embodiment, control 28 comprises a control much as described in U.S. patent application Ser. No. 10/055,800, filed Oct. 26, 2001, titled Electronically Controlled Vehicle Lift And Vehicle Service System. In this embodiment, at initial set up, the type of lift is inputted into control 28 to enable control 28 to select the appropriate operating parameters with respect to system 8. In this embodiment, tube 10 is in fluid communication with source of pressurized air 18 when control 28 is in the operating mode, and the down arrow is depressed to lower the lift engagement structure. During lowering, if end 12 becomes blocked and the predetermined amount of increase in the air pressure is sensed, pressure sensor 16 generates a signal which is provided as an condition signal to control 28 indicative of a lift condition, specifically indicative that the pressure in tube 10 and at pressure sensor 16 has reached a predetermined pressure, indicating liquid above end 12 in internal cavity 6*a*, representing a maintenance condition. Control 28 then interrupts the operation of the lift, and enables display of lift data indicative of this maintenance condition.

Upon such display, actuating the mode key results in enabling the operator to select from two choices, the first of which the operator indicates there is liquid present in internal cavity 6*a*, the second of which the operator indicates there is not liquid present in internal cavity 6*a*.

Upon indication by the operator that there is not liquid present in internal cavity 6*a*, control 28 will enable display of trouble shooting instructions. While in such display, the up and down arrows may be used to scroll through screens of information, including for example, a graphical display of the air system schematic, and the mode key may be actuated to return to the operation mode.

Upon indication by the operator that there is liquid present in internal cavity 6*a*, the operator may actuate the mode key and return to the operation mode.

Upon such return to the operation mode following either indication by the operator, the lift is functional and there is an "alternate home screen" displayed with an indication that there is liquid in containment housing 6 and an indication to press the down key to verify the presence of liquid in containment housing 6. The display will remain in the alternate home display screen state until no liquid is detected in containment housing 6 during lowering, at such time the display will return to the "normal home screen" and remain in that state until liquid is subsequently detected in containment housing 6.

If pressure sensor 16 does not generate a signal during this lowering, presence of liquid in containment housing 6 will not be verified and control 28 returns to "normal" operation.

At power up, the system reboots to normal operation mode, and there will be no indication of liquid in containment housing 6 until the lift is subsequently lowered. Control 28 may be configured to maintain records of the occurrences of high liquid in containment housing. Such records can be date stamped, and maintained permanently, or only on a rolling basis if a permanent record is not desired.

In summary, numerous benefits have been described which result from employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An inground vehicle lift, said lift having at least one vertically moveable lift engagement structure, said inground vehicle lift comprising:

a. a housing defining an internal cavity;

b. a hollow tube having an open end, said open end being disposed within said internal cavity;

c. said hollow tube being in fluid communication with a source of pressurized gas, whereby gas from said source of pressurized gas flows from said end of said tube if said end of said tube is not blocked; and d. a pressure sensor in fluid communication with said source of pressurized gas and said end of said tube, said pressure sensor configured to generate a signal in response to pressure at said pressure sensor exceeding a predetermined pressure.

2. The inground vehicle lift of claim 1, comprising at least one vertically movable post which is retractable at least partially into said internal cavity.

3. The inground vehicle lift of claim 1, wherein said predetermined pressure is gauge pressure.

4. The inground vehicle lift of claim 1, further comprising a control responsive to said signal operably configured to enable display of data indicating that liquid in said internal cavity is in excess of a predetermined level.

5. An inground vehicle lift, said inground vehicle lift having at least one vertically moveable lift engagement structure, said inground vehicle lift comprising:

a. a housing defining an internal cavity;

b. a hollow tube having an open end, said open end being disposed within said internal cavity;

c. said hollow tube being selectively in fluid communication with a source of pressurized gas, whereby gas from said source of pressurized gas flows from said end of said tube if said end of said tube is not blocked; and d. a pressure sensor in fluid communication with said source of pressurized gas and said end of said tube, said pressure sensor configured to generate a signal in response to pressure at said pressure sensor exceeding a predetermined pressure.

6. A method of controlling an inground vehicle lift, said inground vehicle lift having at least one vertically moveable lift engagement structure and a housing defining an internal cavity, said method comprising the steps of:

a. flowing gas through an orifice disposed within said internal cavity;

b. sensing the existence of a predetermined amount of increase in gas pressure as a result of said orifice being blocked by liquid within said internal cavity.

7. The method of claim 6, further comprising the step of selectively flowing gas through said orifice when said at least one vertically moveable lift engagement structure is being lowered.

8. The method of claim 6, comprising the step of generating a signal in response to said sensing the existence of a predetermined amount of increase in gas pressure.

9. The method of claim 8, comprising the step of inhibiting lowering of said at least one vertically moveable lift engagement structure in response to said signal.

* * * * *